US005326231A

United States Patent [19]

Pandeya et al.

[11] Patent Number: 5,326,231

[45] Date of Patent: Jul. 5, 1994

[54] GAS COMPRESSOR CONSTRUCTION AND ASSEMBLY

[75] Inventors: Prakash N. Pandeya, Bristol, Tenn.; Gordon T. Boyd, Abingdon; Robert D. Douglas, Bristol, both of Va.

[73] Assignee: Bristol Compressors

[21] Appl. No.: 16,911

[22] Filed: Feb. 12, 1993

[51] Int. Cl.[5] ..... F01B 1/08; F04B 35/04

[52] U.S. Cl. ..... 417/271; 417/902; 92/128; 92/72; 29/888.02

[58] Field of Search ..... 417/271, 902; 92/128, 92/72; 29/888.02, 888.021, 888.025

[56] References Cited

U.S. PATENT DOCUMENTS

| | | | |
|---|---|---|---|
| 1,890,914 | 12/1932 | Parsons | 92/128 |
| 2,065,162 | 12/1936 | Trask | 417/902 |
| 3,038,414 | 6/1962 | Margus | 92/128 |
| 3,757,581 | 9/1973 | Mankin | 92/72 |
| 4,115,035 | 9/1978 | Tankred et al. | 417/312 |
| 4,230,026 | 10/1980 | Hartley | 92/128 |
| 4,559,686 | 12/1985 | Kessler | 92/128 |
| 4,759,692 | 7/1988 | Morse | 29/888.02 |

*Primary Examiner*—Richard A. Bertsch
*Assistant Examiner*—Peter Korytnyk

[57] ABSTRACT

A gas compressor having a block with two opposed cylinder banks each having at least one cylinder formed therein, each bank having an upper end, a lower end, an inner wall, an outer wall, and opposite side wall, a floor interconnecting the cylinder banks at their lower ends, and a roof interconnecting the cylinder banks at their upper ends, a crankcase formed by the inner walls, roof and floor, the crankcase having a longitudinal axis extending through the roof and floor, first bearing positioned on the floor and aligned with the longitudinal axis for rotatably mounting one end of a crankshaft, an aperture through the roof, a second bearing positioned on the roof and aligned with the longitudinal axis for rotatably mounting the other end of the crankshaft through the aperture, a piston mounted in each cylinder and each having a connecting rod mounted on the crankshaft, the adjacent edge portions of the inner wall, the side walls, the floor and the roof defining an access portal to the crankshaft and to the connecting rods through each side of the block, a drive for the crankshaft for rotating the same and reciprocating the pistons in their cylinders, and suction and discharge valving for admitting the gas to and discharging the gas from the cylinders.

6 Claims, 6 Drawing Sheets

GAS COMPRESSOR CONSTRUCTION AND ASSEMBLY

FIELD OF THE INVENTION

This invention concerns opposed cylinder gas compressors, particularly hermetically sealed gas compressors used in refrigerators, heat pumps, window air conditioning units, or other such applications, and especially concerns novel aspects of the compressor block and crankcase construction and method of assembly of the piston means, crankshaft and connecting rods in the block and crankcase.

BACKGROUND OF THE INVENTION AND PRIOR ART

In compressors having opposed cylinders, and especially those having multiple opposed cylinder pairs, the conventional approach is to employ the scotch yoke type or similar drive for the pistons as shown in U.S. Pat. Nos. 3,807,907; 3,826,036; 3,401,873; 4,352,640; 4,492,127; 4,316,705; 4,273,519; 4,090,430; 2,815,901; 4,373,876; 4,399,669 and 4,988,269. It can readily be seen from these patents that such drive mechanisms require considerably more complex structure, often, e.g., split compressor housings of considerable complexity, and of course more complex machining operations, than is required by the more conventional type of crankshaft, connecting rod combinations which are employed not only in compressors but also in an enormous variety of internal combustion engines and fluid handling power units, and the like. In this regard, the machining equipment and techniques for such conventional combinations represent, by far, the most efficient and inexpensive mode of construction, as well as producing compressors of maximum efficiency and longevity.

Heretofore, however, in the gas compressor field, the use of opposed cylinders and cylinder banks in concert with the aforesaid crankshaft, connecting rod combination has not been developed to a satisfactory commercial level, due at least in part to manipulatory difficulties encountered in the assembly and disassembly of the pistons within the cylinders and in the affixing of the connecting rods to the crankshaft. Such difficulties, e.g., have necessitated the consideration in research and development of split or otherwise complicated crankcase constructions.

Objects therefore of the present invention are: to provide a novel design for opposed cylinder compressors whereby the use of a crankshaft, connecting rod combination can be employed without the need for complex construction, machining or assembly operations; to provide such design which readily accommodates various types and configurations of head and valving constructions; to provide such design with crankcase structure which affords easy accessibility to the crankshaft, the connecting rod bearings and the cylinders; and to provide such design of a compressor block which is easy to cast and machine and which provides, for its weight, maximum strength and vibration counteraction.

SUMMARY OF THE INVENTION

The above and further objects hereinafter becoming apparent have been attained in accordance with the present invention which is defined in its broad sense as a gas compressor comprising block means having opposed cylinder bank means each having at least one cylinder formed therein, each said bank means having an upper end, a lower end, inner wall means, outer wall means, and opposite side wall means, floor means interconnecting said cylinder bank means at their lower ends, and roof means interconnecting said cylinder bank means at their upper ends, crankcase means formed by said inner wall means, roof means and floor means, said crankcase means having a longitudinal axis extending through said roof means and floor means, first bearing means positioned on said floor means and aligned with said axis for rotatably mounting one end of a crankshaft, aperture means through said roof means, second bearing means positioned on said roof means and aligned with said axis for rotatably mounting the other end of said crankshaft through said aperture means, piston means mounted in said cylinders and each having a connecting rod mounted on said crankshaft, the adjacent edge portions of said inner wall means, said side wall means, said floor means and said roof means defining an access portal to said crankshaft and to said connecting rods through each side of said block means, drive means for said crankshaft means for rotating the same and reciprocating said pistons in said cylinders, and suction and discharge valve means for admitting said gas to and discharging said gas from said cylinders.

In certain preferred embodiments:

(a) each said cylinder bank means contains the same number of at least two cylinders, wherein said crankshaft is provided with one half the number of throws as the total number of cylinders, wherein the two cylinders of each opposed cylinder pair are axially displaced from each other, and wherein the connected rods of the opposed piston means of each said cylinder pair are mounted on the same throw;

(b) said connecting rods have split unions for mounting on said throws, and wherein said access portal is wider than the lateral component (LC) of the cycle travel of said unions and is longer than the throw section length (TSL) of said crankshaft;

(c) said access portal is substantially axially centered with respect to said crankcase means; and (d) the compressor has two pairs of opposed cylinders.

DESCRIPTION OF PREFERRED EMBODIMENTS

The present invention will be further understood from the drawings herein of preferred embodiments of the invention and the following description thereof, wherein.

DESCRIPTION OF PREFERRED EMBODIMENTS

Figure 1:
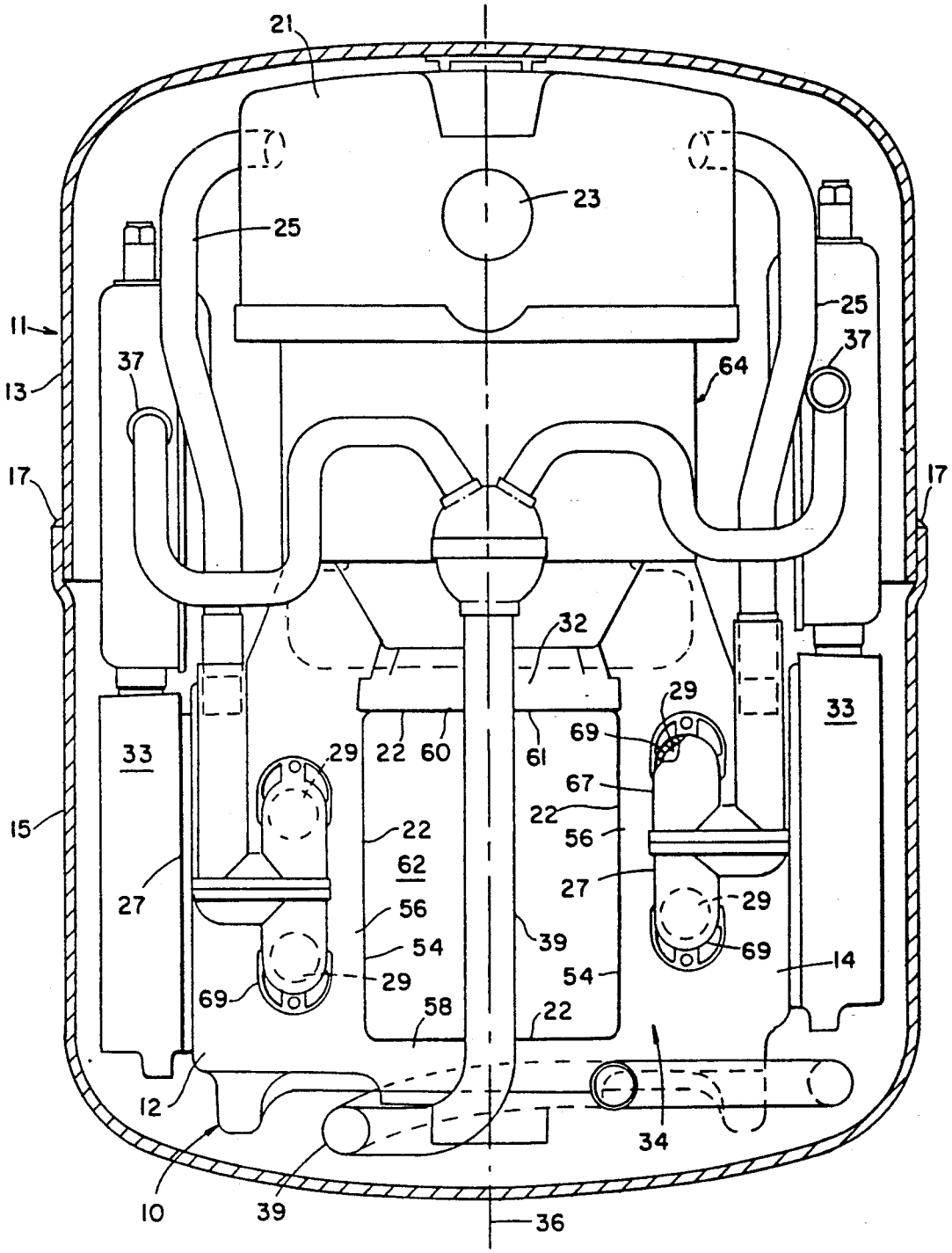
FIG. 1 is a side elevational view of a compressor embodying the present invention, with the outer shell of the compressor unit shown in cross-section, and with the compressor mounting structure not shown.

Referring to the drawings and with reference to the claims hereof, the present gas compressor in the preferred embodiments shown comprises block means 10 having two opposed cylinder bank means 12 and 14 each having an axis or plane 72 and at least one cylinder such as 16 formed therein and having an axis 71, each said bank means having an upper end 18, a lower end 20, inner wall means 22, outer wall means 24, and opposite side wall means 26 and 28, floor means 30 interconnecting said cylinder bank means at their lower ends, and roof means 32 interconnecting said cylinder bank means at their upper ends, crankcase means 34 formed by said inner wall means, roof means and floor means, said crankcase means having a longitudinal axis 36 extending through said roof means and floor means, first bearing means 38 positioned on said floor means and aligned with said axis 36 for rotatably mounting one end 40 of a crankshaft 42, aperture means 44 through said roof means, second bearing means 46 positioned on said roof means and aligned with said axis 36 for rotatably mounting the other end 48 of said crankshaft through said aperture means, piston means 50 mounted in said cylinders and each having a connecting rod 52 mounted on said crankshaft, the adjacent edge portions 54, 56, 58, 60 of said inner wall means, said side wall means, said floor means and said roof means respectively defining an access portal 62 to said crankshaft and to said connecting rods through each side of said block means, drive means 64 for said crankshaft means for rotating the same and reciprocating said pistons in said cylinders, and suction 66 and discharge 68 valve means for admitting said gas to and discharging said gas from said cylinders.

The compressor as shown in detail, especially with regard to the type of suction and discharge valve structure and the piston side ported suction inlet, is shown and described in greater detail in U.S. Pat. Nos. 4,955,796; 5,080,130; and 5,106,278, the disclosures of which are hereby incorporated herein by reference. It is particularly noted that the above mentioned structures for valving and gas flow are preferred, but also are only exemplary of the many compressor structures which can be employed with the present unique block and crankcase structure. Other examples of general compressor valving structures and gas flow patterns which can be used with the present invention are shown in U.S. Pat. Nos. 3,563,677; 4,132,510; 4,353,682; 3,797,969; 2,622,792; and 2,506,751, the disclosures of which are also hereby incorporated herein by reference.

Figure 2:
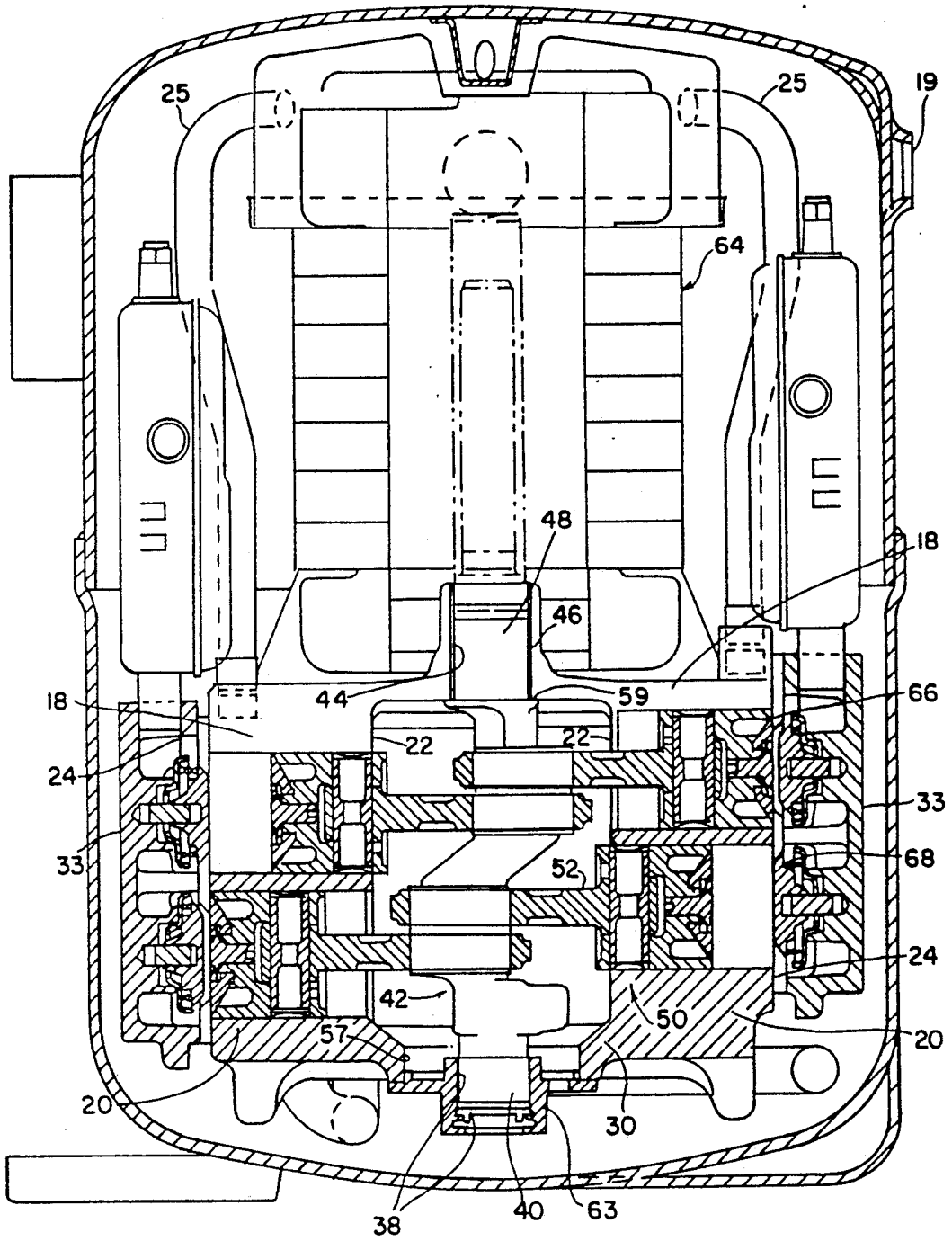
FIG. 2 is a longitudinal cross-sectional view of the compressor of FIG. 1 taken through its longitudinal axis.
Figure 3:
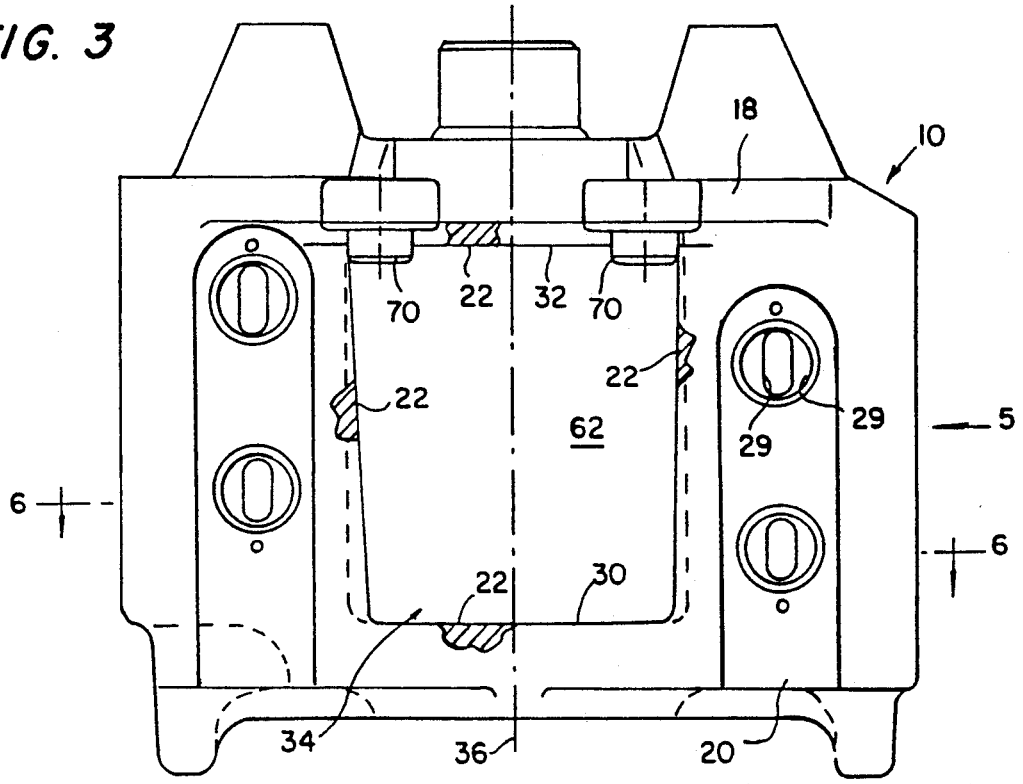
FIG. 3 is a side elevational view of the present compressor block means of FIGS. 1 and 2, with the suction gas conduits and other parts of the compressor removed for clarity.
Figure 4:
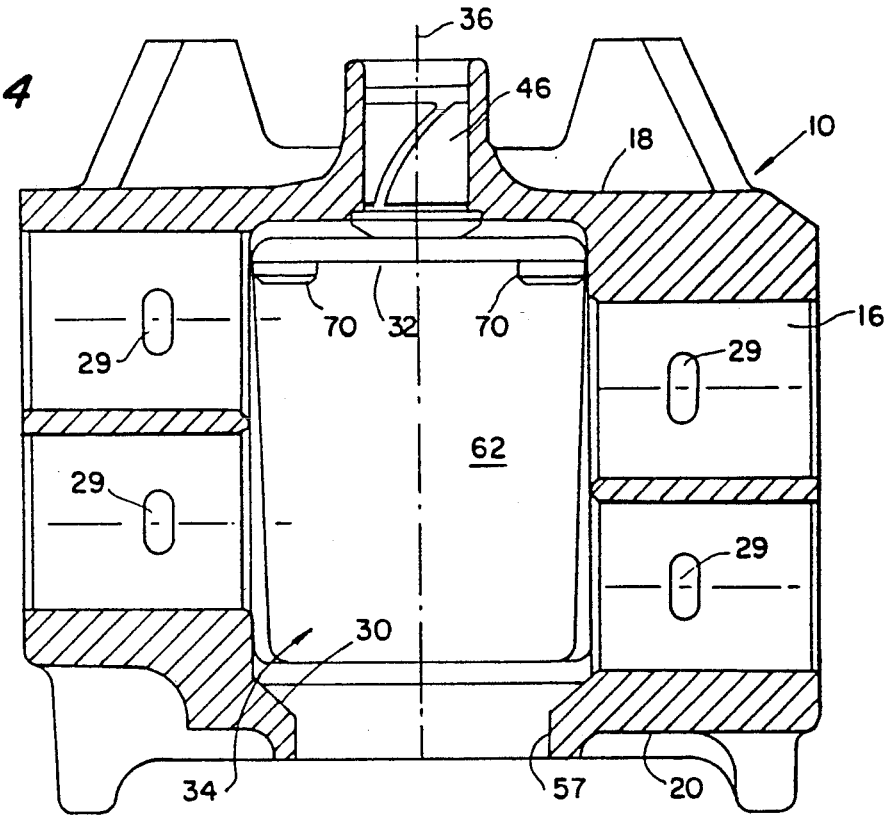
FIG. 4 is a cross-sectional view of the block means of FIG. 3 taken along a vertical plane through the vertical axis of the cylinder bank means.
Figure 5:
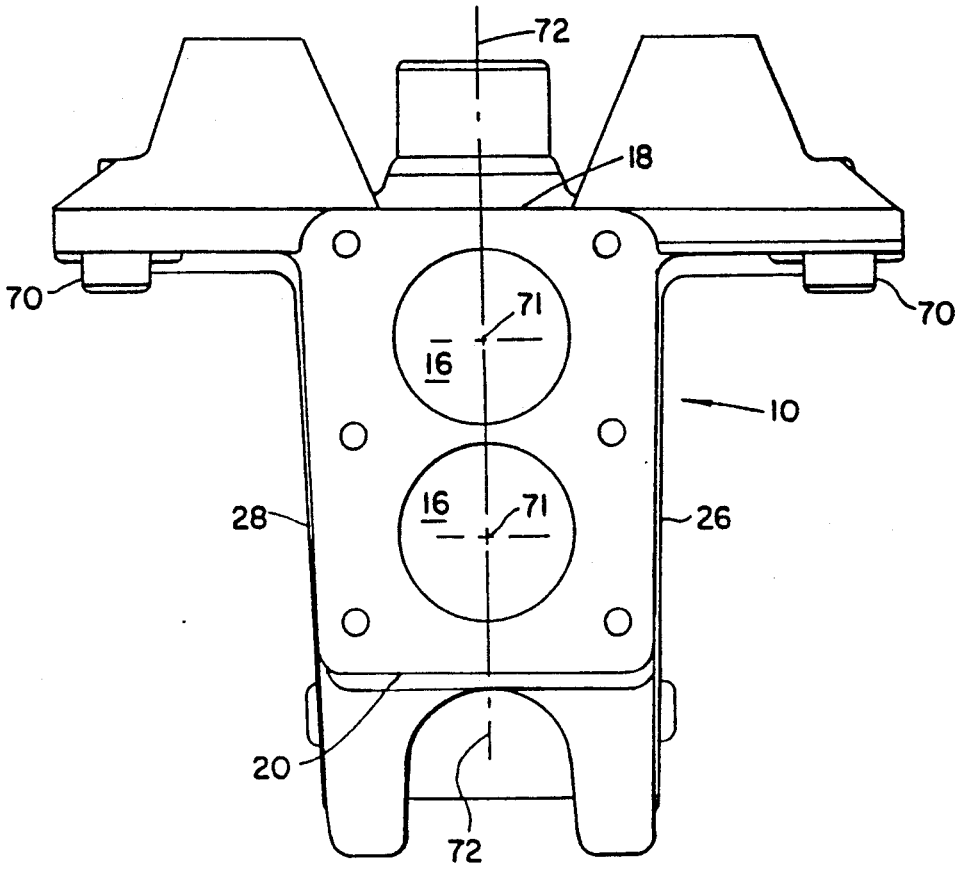
FIG. 5 is an end view of the block means of FIG. 3 taken in the direction of arrow 5 in FIG. 3.
Figure 6:
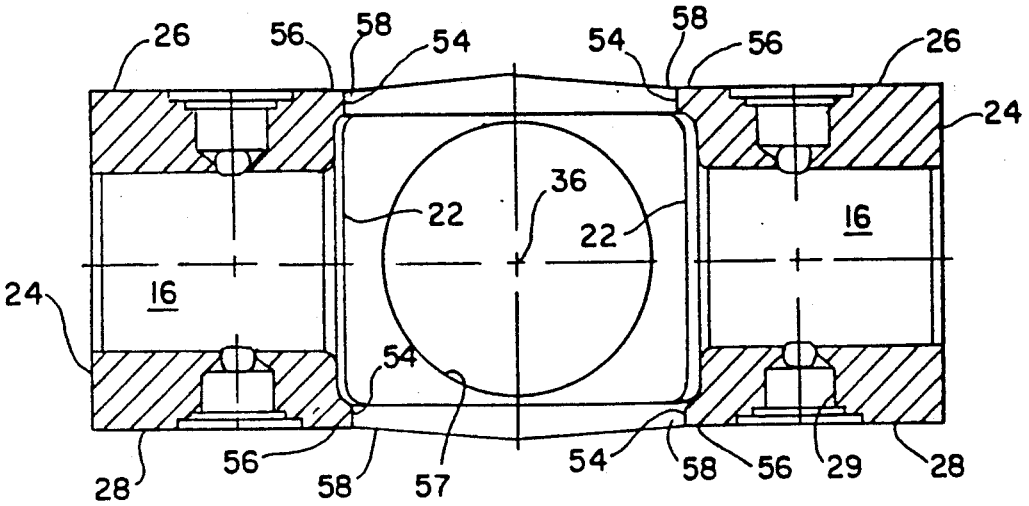
FIG. 6 is a cross-sectional view of the block means of FIG. 3 taken along line 6—6 thereof in the direction of the arrows.

With further reference to FIGS. 1 and 2, the preferred compressor embodiment depicted therein further comprises a shell generally designated 11, comprising upper and lower steel halves 13 and 15 respectively circumferentially welded at 17 to provide a hermetically sealed compressor unit. The gas suction system comprises a suction inlet 19 through shell 11 adapted for connection by brazing, welding, or the like to the low pressure gas return from an evaporator means of a refrigeration system. A suction gas plenum 21 is provided with inlet port means 23 for receiving low pressure gas from the interior of shell 11 or directly from suction inlet 19. Referring further to FIGS. 1 and 2, and to 7, suction gas conduits 25, two for each cylinder bank, are each connected into separate feed splitters 27 which direct suction gas through branches 67 and 69 to suction passages 29 in the side wall means 26 and 28 of each cylinder bank. Each passage 29 is, in turn, in communication with the suction inlet valving in the piston heads by way of suction conduit means 31 formed internally of each piston and being in direct communication with passage 29 over at least a major portion of the reciprocating travel of the piston.

The block means with piston means, crankshaft, electric drive motor 64, and other parts of the compressor affixed is mounted in shell 11 by any suitable means, but preferably by shoulder means 70 integral with the block means and adapted to firmly rest on springs or rubber grommets affixed to shoulder means welded to the inside of said shell.

The cylinder heads 33 communicating with the discharge valving 68 for receiving compressed discharge gas are each provided with a discharge muffler 35 of any suitable construction and the outlets 37 thereof are brazed, welded, or the like into a shock loop 39 in conventional manner, which loop is to be connected through shell 11 into the high pressure side of a refrigeration or the like unit.

Figure 7:
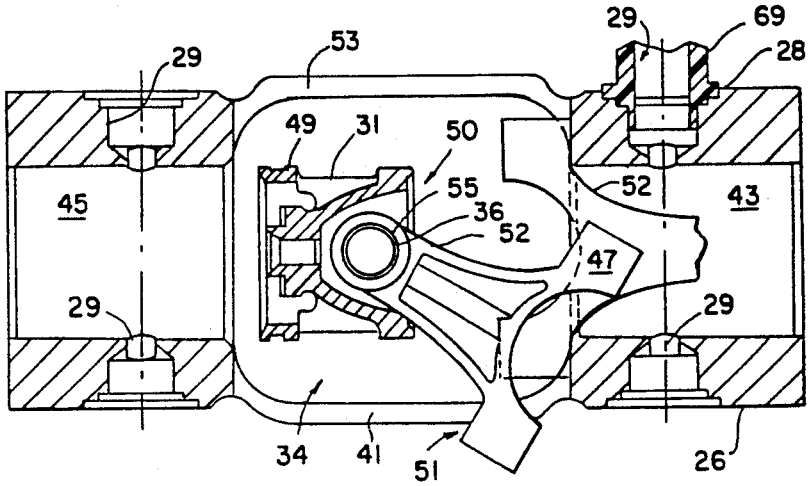
FIG. 7 is a view similar to FIG. 6 but showing a portion of the assembly procedure of the piston in the cylinder.
Figure 8:
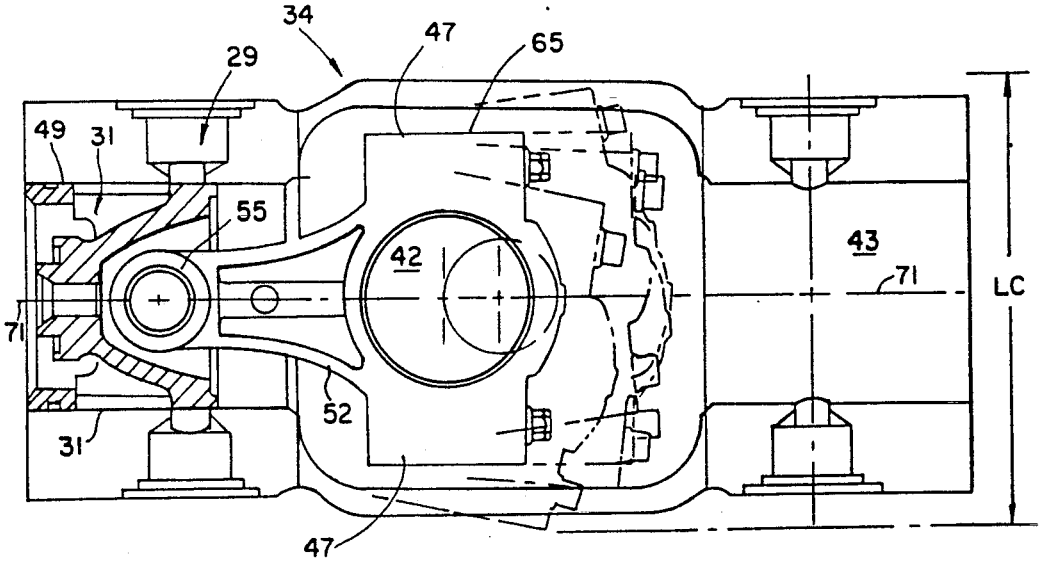
FIG. 8 is a view as in FIG. 7 with the assembly completed and showing the travel of the connecting rod union in phantom lines.
Figure 9:
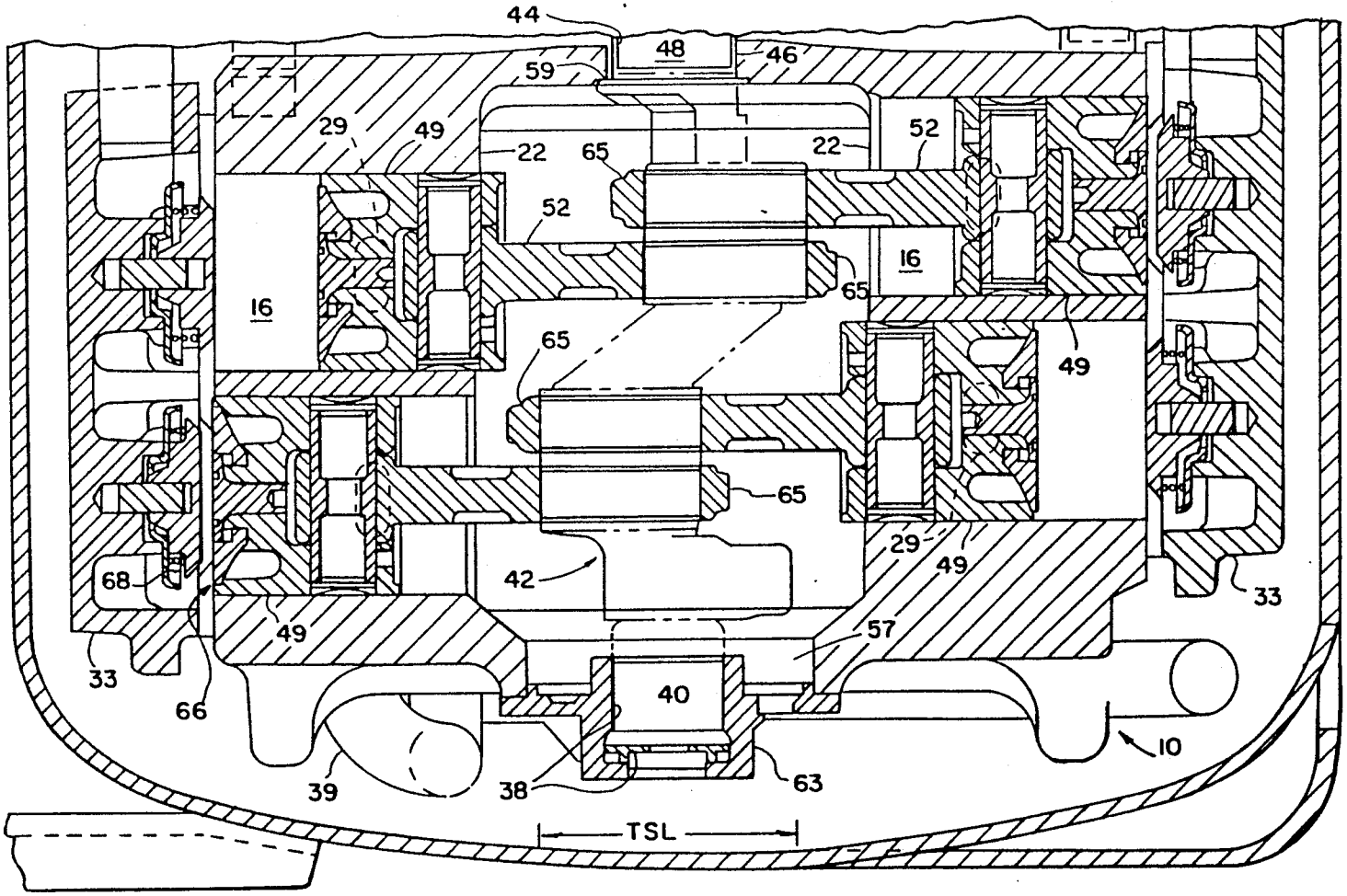
FIG. 9 is an expanded view of the lower portion of the compressor unit of FIG. 2.

Referring to FIGS. 7 and 8, the method of assembling the compressor of claim 1 comprises the steps of:

(a) inserting into said crankcase means 34 through a side 41 or 53 of said access portal 62 and into one cylinder 43 of an opposed cylinder pair 43, 45, one union element 47 of a connecting rod 52 of a piston means 50;

(b) substantially simultaneously with carrying out step (a), maneuvering the piston 49 of said piston means 50, tail first into said crankcase means;

(c) inserting said piston 49, head first into the other cylinder 45 of said pair while simultaneously withdrawing said union element 47 from said one cylinder 43;

(d) continuing the insertion motion of step (c) until the connecting rod union 51 lies adjacent the inner wall means 22 adjacent said other cylinder 45; and (e) repeating steps (a) through (d) for positioning a piston means 50 in said one cylinder of said pair.

In carrying out the above procedure, the union element 47 can be inserted through either side 41 or 53 of the access portal 62, and can be inserted into the one cylinder 43 even when one piston means of the opposed pair has already been positioned in the one cylinder 43. This is made possible in accordance with the present invention by properly dimensioning the opposed cylinder diameters, the degree of misalignment of their axes, the size and shape of the union element 47, the lengths of the pistons and their connecting rods, the degree of rotation of the pistons on the wrist pins 55, the internal dimensions and shape of the crankcase, and the dimensions and shape of the access portals.

The relative dimensions and shapes of these structures as separately shown in FIGS. 1, 2, 7, 8 and 9, and as commonly shown in FIGS. 3, 4, 5 and 6, are actual and operative to allow the above assembly procedure to be carried out. It is noted however, that the above unique assembly procedure can be used for structures which vary somewhat in dimensions and shapes from those shown in the drawings and one skilled in the art can readily define those dimensions and shapes required for employment of the present assembly procedure.

After the piston means have been positioned within the cylinders and crankcase, the crankshaft is inserted, armature end 48 first, through an entry opening 57 formed generally axially through floor means 30, and pushed through second bearing means 46 until stopped by shoulder 59 on the crankshaft bearing against the inner wall of roof means 32. The first bearing means 38 is then fitted over the one end 40 of the crankshaft and the holder 63 for said bearing means is bolted to the floor means 30. This bearing and holder arrangement is described in greater detail in U.S. Pat. No. 5,168,960, the disclosure of which is hereby incorporated herein by reference. The connecting rod caps 65 for each connecting rod are then bolted onto the union elements 47, and the motor armature and cover and other components of the compressor unit assembled in known manner.

The invention has been described in detail with particular reference to preferred embodiments thereof, but it will be understood that variations and modifications will be effected with the spirit and scope of the invention.

We claim:

1. A gas compressor comprising block means having two opposed cylinder bank means each having at least one cylinder formed therein, each said bank means having an upper end, a lower end, inner wall means, outer wall means, and opposite side wall means, floor means interconnecting said cylinder bank means at their lower ends, and roof means interconnecting said cylinder bank means at their upper ends, crankcase means formed by said inner wall means, roof means and floor means, said crankcase means having a longitudinal axis extending through said roof means and floor means, first bearing means positioned on said floor means and aligned with said axis for rotatably mounting one end of a crankshaft, aperture means through said roof means, second bearing means positioned on said roof means and aligned with said axis for rotatably mounting the other end of said crankshaft through said aperture means, piston means mounted in said cylinders and each having a connecting rod mounted on said crankshaft, the adjacent edge portions of said inner wall means, said side wall means, said floor means and said roof means defining an access portal to said crankshaft and to said connecting rods through each side of said block means, drive means for said crankshaft means for rotating the same and reciprocating said pistons in said cylinders, and suction and discharge valve means for admitting said gas to and discharging said gas from said cylinders.

2. The compressor of claim 1 wherein each said cylinder bank means contains the same number of at least two cylinders, wherein said crankshaft is provided with one half the number of throws as the total number of cylinders, wherein the two cylinders of each opposed cylinder pair are axially displaced from each other, and wherein the connecting rods of the opposed piston means of each said cylinder pair are mounted on the same throw.

3. The compressor of claim 2 wherein said connecting rods have split bearing ends for mounting on said throws, and wherein said access portal is wider than the lateral component (LC) of the cycle travel of said bearing ends, and is longer than the throw section length (TSL) of said crankshaft.

4. The compressor of claim 3 wherein said access portal is substantially axially centered with respect to said crankcase means.

5. The compressor of claim 1 having two pairs of opposed cylinders.

6. A block for a gas compressor having opposed cylinder bank means each having at least one cylinder formed therein, each said bank means having an upper end, a lower end, inner wall means, outer wall means, and opposite side wall means, floor means interconnecting said cylinder bank means at their lower ends, and roof means interconnecting said cylinder bank means at their upper ends, crankcase means formed by said inner wall means, roof means and floor means, said crankcase means having a longitudinal axis extending through said roof means and floor means, entry opening means formed generally axially through said floor means for receiving a crankshaft therethrough, and aperture means through said roof means for receiving therethrough the armature end of a crankshaft, the adjacent edge portions of said inner wall means, said side wall means, said floor means and said roof means defining an access portal to a crankshaft and connecting rods through each side of said block means.

* * * * *